United States Patent [19]

Weiss

[11] Patent Number: 4,749,902

[45] Date of Patent: Jun. 7, 1988

[54] LAMP WITH A BULB MADE OF A HIGH SILICA CONTENT GLASS

[75] Inventor: Werner Weiss, Stadtbergen, Fed. Rep. of Germany

[73] Assignee: Patent Treuhand Gesellschaft fur elektrische Gluhlampen mbH, Munich, Fed. Rep. of Germany

[21] Appl. No.: 937,552

[22] Filed: Dec. 3, 1986

[30] Foreign Application Priority Data

Dec. 18, 1985 [DE] Fed. Rep. of Germany ..... 3544825

[51] Int. Cl.[4] ..... H01J 5/32

[52] U.S. Cl. ..... 313/332; 313/578; 313/579; 313/623; 313/636

[58] Field of Search ..... 313/636, 623, 43, 578, 313/579, 315, 331, 332, 318

[56] References Cited

U.S. PATENT DOCUMENTS 3,420,944 1/1969 Holcomb .
3,515,420 6/1970 Thomasson et al. ..... 313/578 X
3,723,790 3/1973 Dumbaugh, Jr. et al. ..... 313/578 X
4,238,705 12/1980 Thomas ..... 313/579

FOREIGN PATENT DOCUMENTS 2058213 6/1971 Fed. Rep. of Germany ..... 313/578
1485378 9/1977 United Kingdom .

*Primary Examiner*—David K. Moore
*Assistant Examiner*—Mike Horabik
*Attorney, Agent, or Firm*—Frishauf, Holtz, Goodman & Woodward

[57] ABSTRACT

To improve tightness of a pinch or press seal (*2a;* 13*a*, 13*b*) between a molybdenum foil and quartz or similar hard glass of an electric lamp, typically a halogen incandescent lamp or metal halide discharge lamp, an intermediate melt glass layer in form of a strip is applied to the sealing foil, which has the following main components:

$SiO_2$: 60–70%
$Al_2O_3$: 3–20%
$K_2O$: 12–18, all percentages by weight, the glass being, except for trace contaminants, free from $Na_2O$. In a preferred form, the main components are:

$SiO_2$: 66%
$Al_2O_3$: 18% $K_2O$: 15%, all percentages by weight.

18 Claims, 1 Drawing Sheet

LAMP WITH A BULB MADE OF A HIGH SILICA CONTENT GLASS

The present invention relates to lamps, and more particularly to a lamp bulb which is made of a glass having a high silica content, for example vycor or quartz glass, and which is particularly adapted to have electrical connections melt-connected in the glass, for example in a press or pinch seal. A binder glass or solder glass substance is located between the foil and the glass of the bulb. The glass layer or substance improves the seal.

BACKGROUND

It is well known to connect electrical leads to a pinch or press seal in a lamp. When using high silica containing glass in which, for example, the silicon oxide proportion is at least 96% - by weight, foils, for example of molybdenum, are melted into the press or pinch seal.

The technology of vacuum-tight melt connection of electrical supply leads through a pinch or press seal and into a bulb by use of foils is applied, primarily, in halogen incandescent lamps and in metal halide discharge lamps. Usually, the bulbs are made of quartz glass and the foils are made of molybdenum.

The tightness of the melt connection between the molybdenum and quartz glass can be improved by an intermediate layer. It has been proposed to coat the molybdenum foil with a layer of chromium to protect the molybdenum foil against oxidation, see, for example, U.S. Pat. No. 3,420,944. It has also been proposed to use an intermediate connectng solder glass, for example including leadphosphorus- oxide, see British Pat. No. 1,485,378. Substantial differences in thermal coefficients of expansion between molybdenum and quartz can be alleviated by interposition of one or more intermediate layers of glass having high boron oxide content, with coefficients of expansion between the extremes of the molybdenum and the quartz glass see French Pat. No. 961 730. The thermal coefficient of expansion of molybdenum is about $50 \cdot 10^{-7}$/ K; that of quartz glass $7 \cdot 10^{-7}$/ K.

Vapor-depositing thin metal layers is costly both with respect to material requirements as well as apparatus and technological requirements of the process of vapor deposition. Lead-phosphorus-oxide is not suitable for high temperatures and, thus, cannot be readily used in halogen incandescent lamps or metal halide discharge lamps, which operate at high bulb and internal temperatures, typically in the order of several hundred degrees C. Intermediate glass layers which have been proposed to ameliorate the differences in thermal coefficients of expansion are also not suitable for high temperatures. Application of a plurality of intermediate layers, with respectively different thermal coefficients of expansion, is very costly. Such glasses may include boron oxide.

THE INVENTION

It is an object to provide a lamp having a lamp bulb of high silicon oxide content—typically 96% by weight or more—or of quartz glass, in which electrical connections in the form of foils can readily be passed through a pinch or press seal between the bulb and the outside thereof.

Briefly, a solder glass layer is placed between the foil and the glass of the bulb which has the following primary contents in percent:

$SiO_2$: 60–70
$Al_2O_3$: 3–20
$K_2O$: 12–18, all percentages by weight. Except for minor impurities, the glass is to be free of $Na_2O$.

A lamp which is constructed with the solder glass in accordance with the invention is capable of loading to high temperatures, and is resistant to chemical deterioration, and thus is suitable for lamps containing halogen or halides, and especially for such having high power. Thus, the lifetime of such lamps is extended.

The solder glass layer in accordance with the present invention not only prevents oxidation of the foils, but also improves the wetting characteristics and the wetting speed of the quartz glass - molybdenum system. The solder glass has substantially improved adhesive characteristics. Thus, the fact that the thermal coefficients of expansion do not match becomes a negligible factor. No additional pre-treatment is necessary to permit application of the glass melt on the foil.

In a preeferred embodiment, the solder glass has these primary components:

$SiO_2$: 66%
$Al_2O_3$: 18%
$K_2O$: 15%, all percentages by weight.

In the preferred embodiment, the solder glass can be readily obtained from potassium feldspar (orthoclase).

In accordance with a particularly preferred form, the solder glass is applied to the foil in a quantity of 5–10 $mg/cm^2$. This quantity of application is not critical. Applying a lesser quantity, however, does not reliably insure complete wetting of an extensive continuous surface on the foil. Applying a greater quantity progressively interferes with the tightness of the melt, since the thickness of the resulting layer increases.

DRAWING

FIG. 1 is a schematic side view of a single-ended halogen incandescent lamp in accordance with the present invention; and FIG. 2 is a schematic side view of a double-ended metal halide discharge lamp in accordance with the present invention.

DETAILED DESCRIPTION

Figure 1:
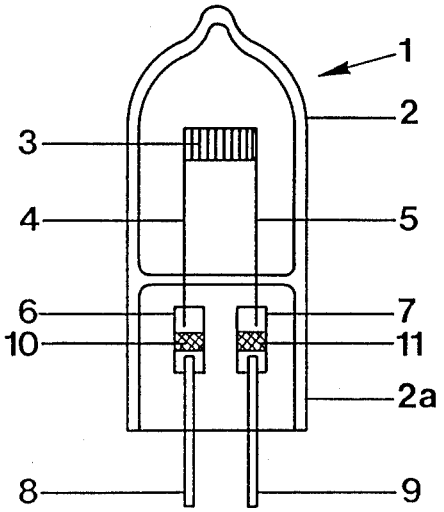

Referring first to FIG. 1: A single-ended halogen incandescent lamp 1 of high power is shown in which a quartz glass bulb 2 retains a twisted filament 3 which is secured to two inner current supply leads 4, 5. The inner supply leads 4, 5 are connected, for example by welding, to molybdenum foils 6, 7 which, in turn, are connected to outer current supply leads 8, 9 which may also serve as connecting terminals. The filament 3 is made of tungsten; the current supply leads 4, 5 and 8, 9 are made of molybdenum.

Operating temperatures of 400° C. and up may occur in the region of the press seal 2*a*. In order to insure vacuum tightness, a horizontal cross strip is located in the center of the foils 6, 7 on which the solder glass in accordance with the present invention and previously described has been applied. The solder glass layers 10, 11 on each of the foils 6, 7 have a thickness of about 20 micrometers. The end regions of the foils 6, 7 on which the current supply leads 4, 5 and 8, 9 terminate respectively, do not have the coatings 10, 11 applied—see FIG. 1. An additional outer bulb may be used surrounding the bulb 2 in order to increase safety in operation.

Figure 2:
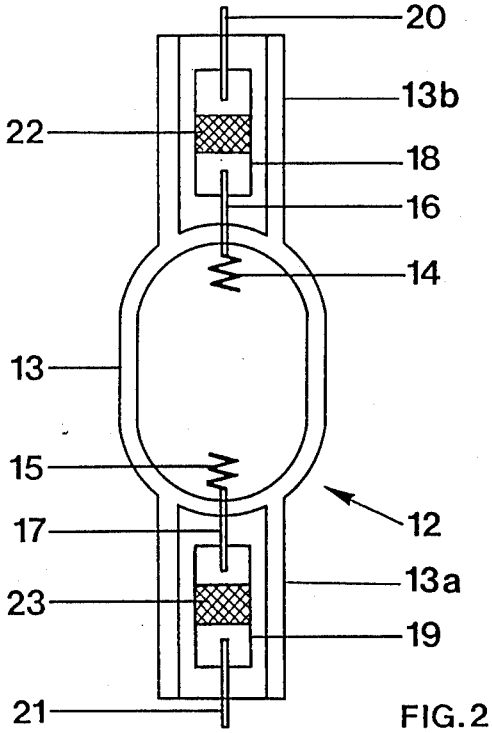

FIG. 2 illustrates an embodiment of a double-ended metal halide discharge lamp 12. A quartz glass bulb 13 has two electrodes 14, 15 located therein, which are, respectively, connected to inner current supply leads 16, 17. The current supply leads 16, 17 are connected through the pinch or press seals **13*a*, 13*b* by melt connection, in which the foils 18, 19 are placed, the foils being melted-in into the pinch or press seal. The conductive connection between the foils 18, 19 towards the outside is obtained by the two external current supply leads 20,21**.

In accordance with the present invention, and similar to the embodiment of FIG. 1, the tightness of the melt seals 13a, 13b is obtained by a layer 22, 23 applied, respectively, across the center portion of the foils 18, 19, the solder glass layer 22, 23 having the composition previously described.

Method of making the lamp: The layers 10, 11; 22, 23 are applied in this manner: First, a suspension is made of ground solder glass with an organic carrier substance. This suspension is applied to the foils 6, 7; 18, 19 in a neutral atmosphere, for example a nitrogen atmosphere. The foils already will have the current supply leads 4, 5, 8, 9; 16, 17, 20, 21 applied thereto, to form a current supply lead - foil subassembly. After application of the suspension with the solder glass therein, the strips are dried, which can be obtained by permitting the suspension medium to evaporate, for example for 1–2 minutes. The bulbs 2 or 13, respectively, and the subassemblies of the foil - lead-ins, together with the electrodes 3 or 14, 15, respectively, in place, are then heated to about 2000° C., introduced into the bulb, and the pinch seal regions **2*a*; 13*a* 13*b*** are compressed or pinched to form the pinch or press seal. During the pinching process, the solder glass might be available in liquid form on the surface of the foil without, however, flowing or running off the foil. Thus, the viscosity of the solder glass must be such that it is neither too little nor too high.

In accordance with a preferred feature of the invention, and particularly easily meeting the viscosity requirements, two compositions of solder glass are especially suitable—all components by weight:

EXAMPLE 1

The melt glass contains 15% $K_2O$, 18% $A1_2O_3$, remainder $SiO_2$.

EXAMPLE 2

The melt glass contains 16.1% $K_2O$, 3.5% $A1_2O_3$, 64.7% $SiO_2$; in addition, compatible components, especially alkaline earth oxides, may be contained therein.

The solder glass of Example 2 has a lower melting point than that of Example 1. Both glasses have a thermal coefficient of expansion of about $80 \cdot 10^{-7}$/ K.

The improved adhesive or connecting effect between the molybdenum foil and the quartz glass can be shown by measuring the wetting angle of a quartz glass drop on a molybdenum foil.

EXPERIMENT

Applying a quartz glass drop, a wetting angle of about 100° can be measured, independently of the type of quartz glass and possible doping. Upon placing a strip of solder glass in accordance with the present invention on the molybdenum foil, however, and then applying a similar quartz glass thereon, the wetting angle of a drop of quartz glass was reduced to about 45°. This angle is nearly the same regardless of the specific composition of the glass, that is, regardless of whether the glass of Example 1 or Example 2 is used. Thus, a substantial improvement of the wetting characteristics is demonstrated.

A suitable suspension vehicle for the ground solder glass to be applied in form of a suspension is a mixture of ammonium polyacrylate, water and alcohol. This suspension medium can be dried at room temperature.

I claim:

1. Electric lamp (1, 12) having a bulb (2, 13) of a glass which has a silicon oxide content of at least 96%;

current supply leads (4, 5, 8, 9; 16, 17, 20, 21) extending, respectively, within the bulb and outwardly from the bulb;

foil connections including two foils (6, 7; 18, 19) each having two sides located between the current supply leads extending inwardly and outwardly, respectively, from the bulb;

a solder glass layer located between the glass of the bulb and the respective side of the foil; and a melt connection, vacuum-tightly melting the foil connections into an end portion of the bulb, wherein, in accordance with the invention, the solder glass has the characteristic of high wetting and adhesion capability with respect to the foil connection quartz glass system to prevent oxidation of the foils, said solder glass being, except for trace contaminants, free from $Na_2O$, and having the following main components:

$SiO_2$: 60–70%

$A1_2O_3$: 3–20%

$K_2O$: 12–18%, all percentages by weight.

2. Lamp according to claim 1, wherein the solder glass has the following main components:

$SiO_2$ : 66%

$A1_2O_3$ : 18%

$K_2O$ : 15%.

3. Lamp according to claim 1, wherein the solder glass has the following main components:

$SiO_2$ : 64.7%

$A1_2O_3$ : 3.5%

$K_2O$ : 16.1%.

4. Lamp according to claim 3, further including minor amounts of alkaline earth oxides.

5. Lamp according to claim 2, including minor amounts of alkaline earth oxides.

6. Lamp according to claim 1, wherein the solder glass is applied to the foil in a quantity of about 5–10 mg/cm$^2$.

7. Lamp according to claim 1, wherein the solder glass is applied to the foil in form of a strip transverse to a longitudinal axis of the lamp.

8. Lamp according to claim 7, wherein the thickness of said strip is in the order of about 20 micrometers.

9. Electric lamp (1, 12) having a bulb (2, 13) of a glass which has a silicon oxide content of at least 96%;

current supply leads (4, 5, 8, 9; 16, 17, 20, 21) extending, respectively, within the bulb and outwardly from the bulb;

foil connections including two foils (6, 7; 18, 19) each having two sides located between the current supply leads extending inwardly and outwardly, respectively, from the bulb;

a solder glass located between the glass of the bulb and the respective side of the foil; and a melt connection, vacuum-tightly melting the foil connections into an end portion of the bulb, wherein, in accordance with the invention, the solder glass has the characteristic of high wetting and adhesion capability with respect to the foil connection quartz glass system to prevent oxidation of the foils, said solder glass being, except for trace contaminants, free from $Na_2O$, and consisting essentially of the following main components:

$SiO_2$ : 60–70%

$Al_2O_3$ : 3–20%

$K_2O$ : 12–18%, all percentages by weight.

10. Lamp according to claim 9, wherein the solder glass consists essentially of the following main components:

$SiO_2$ : 66%

$Al_2O_3$ : 18%

$K_2O$ : 15%.

11. Lamp according to claim 9, wherein the solder glass consists essentially of the following main components.

$SiO_2$ : 64.7%

$Al_2O_3$ : 3.5%

$K_2O$ : 16.1%.

12. Lamp according to claim 11, further including minor amounts of alkaline earth oxides.

13. Lamp according to claim 10, including minor amounts of alkaline earth oxides.

14. Lamp according to claim 9, wherein the solder glass is applied to the foil in a quantity of about 5–10 $mg/cm^2$.

15. Lamp according to claim 9, wherein the solder glass is applied to the foil in form of a strip transverse to a longitudinal axis of the lamp.

16. Lamp according to claim 15, wherein the thickness of said strip is in the order of about 20 micrometers.

17. Lamp according to claim 1, wherein said foils are molybdenum foils.

18. Lamp according to claim 9, wherein said foils consist essentially of molybdenum foils.

* * * * *